US011174063B2

(12) United States Patent
Linvill et al.

(10) Patent No.: US 11,174,063 B2
(45) Date of Patent: Nov. 16, 2021

(54) COATED PAPERBOARD CONTAINER, METHOD OF MANUFACTURING A COATED PAPERBOARD CONTAINER, AND CUP BOTTOM FORMING APPARATUS

(71) Applicant: WestRock MWV, LLC, Atlanta, GA (US)

(72) Inventors: Eric D. Linvill, Alvsjo (SE); Jiebin Pang, Glen Allen, VA (US); Natasha G. Melton, Richmond, VA (US); James M. Taylor, Highland Springs, VA (US); Steven Parker, Raleigh, NC (US)

(73) Assignee: WESTROCK MWV, LLC, Atlanta, GA (US)

( * ) Notice: Subject to any disclaimer, the term of this patent is extended or adjusted under 35 U.S.C. 154(b) by 0 days.

(21) Appl. No.: 16/391,548

(22) Filed: Apr. 23, 2019

(65) Prior Publication Data

US 2019/0329928 A1 Oct. 31, 2019

Related U.S. Application Data

(60) Provisional application No. 62/664,404, filed on Apr. 30, 2018.

(51) Int. Cl.
*B65D 3/06* (2006.01)
*B31B 50/16* (2017.01)
(Continued)

(52) U.S. Cl.
CPC ..... *B65D 3/06* (2013.01); *B31B 50/16* (2017.08); *B31B 50/592* (2018.05);
(Continued)

(58) Field of Classification Search
CPC ..... B31B 2105/00; B31B 2110/10; B31B 2110/20; B31B 2105/001;
(Continued)

(56) References Cited

U.S. PATENT DOCUMENTS 3,503,310 A * 3/1970 Goetz ..... B31C 3/00 493/106
4,026,458 A * 5/1977 Morris ..... B31F 1/0077 229/182.1

(Continued)

FOREIGN PATENT DOCUMENTS

EP 0 991 815 4/2000
EP 2 719 825 4/2014

(Continued)

OTHER PUBLICATIONS

International Search Report dated Aug. 8, 2019 from PCT/US19/28662.

(Continued)

*Primary Examiner* — Andrew M Tecco
*Assistant Examiner* — Nicholas E Igbokwe
(74) *Attorney, Agent, or Firm* — Neil G. Cohen

(57) ABSTRACT

A method of manufacturing a coated paperboard container includes: providing a coated paperboard bottom blank, the coated paperboard bottom blank comprising a paperboard substrate and a first barrier coating layer on a first outermost surface of the paperboard substrate; heating the coated paperboard bottom blank; shaping the heated coated paperboard bottom blank, thereby forming a peripheral skirt portion about a periphery of a bottom wall portion of the coated paperboard bottom blank; and sealing a coated paperboard sidewall to the first barrier coating layer of the peripheral skirt portion.

13 Claims, 10 Drawing Sheets

(51) Int. Cl.

| | |
|---|---|
| ***B31B 50/59*** | (2017.01) |
| ***B31B 50/74*** | (2017.01) |
| ***B65D 3/14*** | (2006.01) |
| ***B65D 65/42*** | (2006.01) |
| *B31B 105/00* | (2017.01) |
| *B31B 110/10* | (2017.01) |

(52) U.S. Cl.
CPC ..... *B31B 50/741* (2017.08); *B31B 50/747* (2017.08); *B65D 3/14* (2013.01); *B65D 65/42* (2013.01); *B31B 2105/00* (2017.08); *B31B 2110/10* (2017.08)

(58) Field of Classification Search
CPC ..... B31B 2105/0022; B31B 50/16; B31B 50/592; B31B 50/741; B31B 50/747; B31F 1/0093; B65D 65/42
See application file for complete search history.

(56) References Cited

U.S. PATENT DOCUMENTS

| | | | | |
|---|---|---|---|---|
| 4,258,529 | A * | 3/1981 | Smith | B65D 51/145 53/478 |
| 5,731,377 | A | 3/1998 | Friel | |
| 5,763,100 | A | 6/1998 | Quick et al. | |
| 6,135,936 | A | 10/2000 | Brown et al. | |
| 9,068,105 | B2 | 6/2015 | VonFelden et al. | |
| 9,732,474 | B2 | 8/2017 | Koenig et al. | |
| 9,803,088 | B2 | 10/2017 | Iyer et al. | |
| 9,868,876 | B2 | 1/2018 | Pratt et al. | |
| 2002/0136913 | A1 | 9/2002 | Schaedler et al. | |
| 2003/0152724 | A1* | 8/2003 | Swoboda | B65D 81/3823 428/34.2 |
| 2008/0041860 | A1* | 2/2008 | Wiedmeyer | B65D 81/3874 220/592.26 |
| 2011/0046284 | A1 | 2/2011 | Berube et al. | |
| 2011/0262745 | A1* | 10/2011 | Ronka | D21H 19/24 428/349 |
| 2012/0302660 | A1 | 11/2012 | Stanssens et al. | |
| 2013/0092312 | A1* | 4/2013 | Cassoni | B31B 50/592 156/69 |
| 2014/0155239 | A1* | 6/2014 | Walsh | B31B 50/36 493/128 |
| 2014/0255630 | A1* | 9/2014 | Kunihiro | B65D 1/265 428/34.2 |
| 2015/0111011 | A1 | 4/2015 | Hoekstra et al. | |
| 2015/0344729 | A1 | 12/2015 | Breese et al. | |
| 2015/0360845 | A1* | 12/2015 | Stahlecker | B65D 3/30 229/403 |
| 2016/0153149 | A1 | 6/2016 | Mongrain | |
| 2016/0168799 | A1 | 6/2016 | Constant | |
| 2017/0002517 | A1 | 1/2017 | Pang et al. | |
| 2018/0245291 | A1 | 8/2018 | Pang et al. | |

FOREIGN PATENT DOCUMENTS

| | | | |
|---|---|---|---|
| EP | 2764991 | A1 | 8/2014 |
| JP | 2013-82109 | | 5/2013 |
| WO | WO 94/26513 | | 11/1994 |
| WO | WO 02/47523 | A1 | 6/2002 |
| WO | WO2010/135613 | A1 | 11/2010 |
| WO | WO2013056205 | A2 | 4/2013 |
| WO | WO 2016170229 | | 10/2016 |
| WO | WO 2016183314 | | 11/2016 |

OTHER PUBLICATIONS

AkzoNobel, media release, "AkzoNobel creates world's first fully compostable and recyclable paper cup," https://www.akzonobel.com/en/for-media/media-releases-and-features/akzonobel-creates-worlds-first-fully-compostable-and (Aug. 7, 2014).
European Patent Office, Translation of JP 2013-82109 (Apr. 20, 2018).

* cited by examiner

| Staining of cup due to coffee with non-dairy creamer for punch and heating combinations, Examples 1-4 | | |
|---|---|---|
| | No Heating | 1100°F Hot Air & 120°F Heated Die |
| Conventional punch |  |  |
| Punch with 4/32" Leading-Edge Radius (R = 8.09t) |  |  |

| Staining of cup due to coffee with non-dairy creamer for various punch conditions and a constant heating condition, Examples 5–9 | |
|---|---|
| | 1100°F Hot Air & 120°F Heated Die |
| Convention al punch |  |
| Punch with 1.5/32" Leading- Edge Radius (R = 3.3t) |  |
| Punch with 2/32" Leading-Edge Radius (R = 4.5t) |  |
| Punch with 3/32" Leading-Edge Radius (R = 6.7t) |  |
| Punch with 4/32" Leading-Edge Radius (R = 8.9t) |  |

COATED PAPERBOARD CONTAINER, METHOD OF MANUFACTURING A COATED PAPERBOARD CONTAINER, AND CUP BOTTOM FORMING APPARATUS

PRIORITY

This application claims priority from U.S. Ser. No. 62/664,404 filed on Apr. 30, 2018, the entire contents of which are incorporated herein by reference.

FIELD

The present application relates to the field of coated paperboard containers, in particular, coated paperboard cups and tubs.

BACKGROUND

Coated paperboard is used in various packaging applications. For example, coated paperboard is used to package beverage containers, frozen foods, cereals and a wide variety of other food and non-food consumer goods. Coated paperboard is often required to have enhanced barrier properties, including oil, grease, water, and/or moisture vapor barrier properties. Additionally, many paperboard packages, for example, paperboard cups for food or drink services, also require the paperboard be heat-sealable, making it possible to form cups on a cup machine. Conventional polyethylene extrusion coated paperboard dominates in such applications by providing both barrier and heat-seal properties.

However, conventional polyethylene extrusion coated paperboard has difficulties in repulping and are not easily recyclable, causing environmental concerns.

Repulpable aqueous coatings are one of the promising solutions to address this need. However, the use of repulpable aqueous coatings has presented challenges with regards to cracking of the coatings when shaping a coated paperboard bottom blank for use in a paperboard container.

Accordingly, those skilled in the art continue with research and development efforts in the field of coated paperboard containers.

SUMMARY

In one embodiment, a method of manufacturing a coated paperboard container includes: providing a paperboard bottom blank, the paperboard bottom blank comprising a paperboard substrate and a first barrier coating layer on a first outermost surface of the paperboard substrate; heating the coated paperboard bottom blank; shaping the heated coated paperboard bottom blank, thereby forming a peripheral skirt portion about a periphery of a bottom wall portion of the coated paperboard bottom blank; and sealing a coated paperboard sidewall to the first barrier coating layer of the peripheral skirt portion.

In another embodiment, a method of manufacturing a coated paperboard container includes: providing a paperboard bottom blank having a caliper thickness t, the paperboard bottom blank comprising a paperboard substrate and a first barrier coating layer on a first outermost surface of the paperboard substrate; shaping the coated paperboard bottom blank using a punch, thereby forming a peripheral skirt portion about a periphery of a bottom wall portion of the coated paperboard bottom blank, the punch having a leading-edge radius of greater than 3t; and sealing a coated paperboard sidewall to the first barrier coating layer of the peripheral skirt portion.

In yet another embodiment, a coated paperboard container includes: a coated paperboard bottom having a caliper thickness t, the coated paperboard bottom comprising a paperboard substrate and a first barrier coating layer on a first outermost surface of the paperboard substrate, the coated paperboard bottom having a peripheral skirt portion formed about a periphery of a bottom wall portion, wherein a radius defining between the peripheral skirt portion and the bottom wall portion is greater than 3t; and a coated paperboard sidewall sealed to the first barrier coating layer of the peripheral skirt portion.

In yet another embodiment, a cup bottom forming apparatus includes: a punching assembly for shaping a coated paperboard bottom blank to form a peripheral skirt portion about a periphery of a bottom wall portion of the coated paperboard bottom blank; and a heater positioned to heat the coated paperboard bottom blank prior to and/or during formation of the peripheral skirt portion.

Other embodiments of the disclosed methods and coated paperboard containers will become apparent from the following detailed description, the accompanying drawings and the appended claims.

DETAILED DESCRIPTION

It has now been discovered that cracking of a coating during a shaping process of a coated paperboard bottom blank can be reduced by pre-heating of the coated paperboard bottom blank before the shaping process and by increasing a leading-edge radius of a punch used during the shaping process. Conventional polymer extrusion coatings, such as polyethylene, typically survive the forming process without cracking even without these modifications. These modifications allow for less-flexible, more brittle, or less strong coatings to survive the forming process with less cracking.

Figure 1:
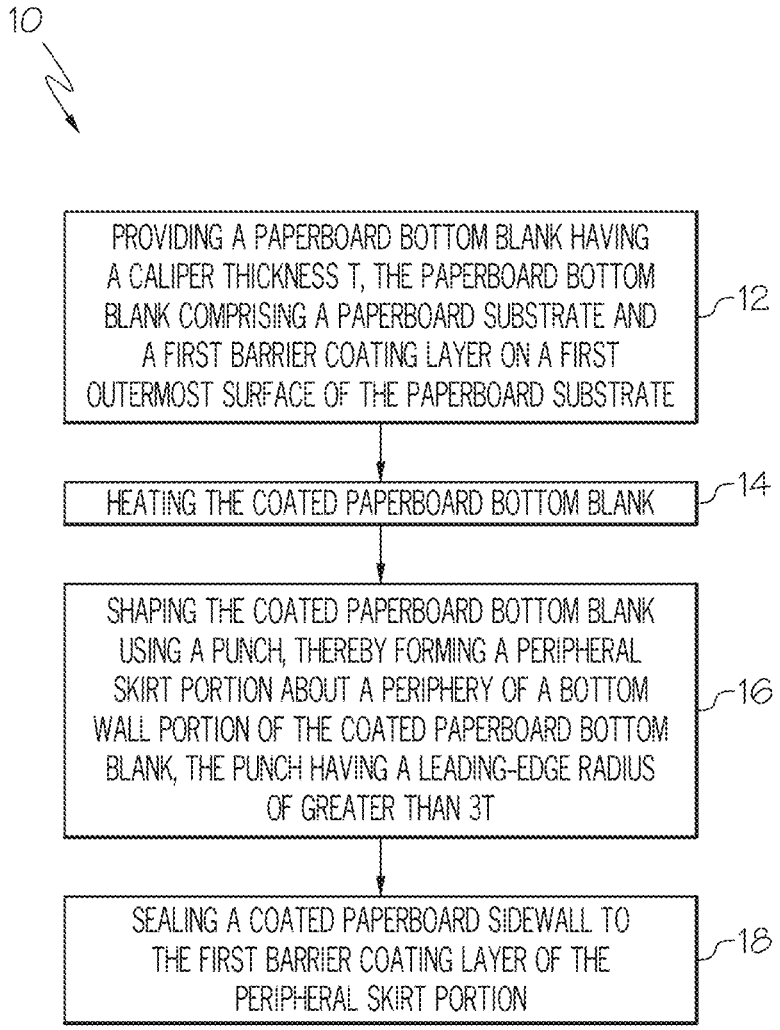
FIG. 1 is a flow chart representing an exemplary method of manufacturing a coated paperboard container.

FIG. 1 is a flow chart representing an exemplary method 10 of manufacturing a coated paperboard container. The method includes, at block 12, providing a coated paperboard bottom blank having caliper thickness t, an example of which is illustrated in FIGS. 2A and 2B.

Figure 2A:
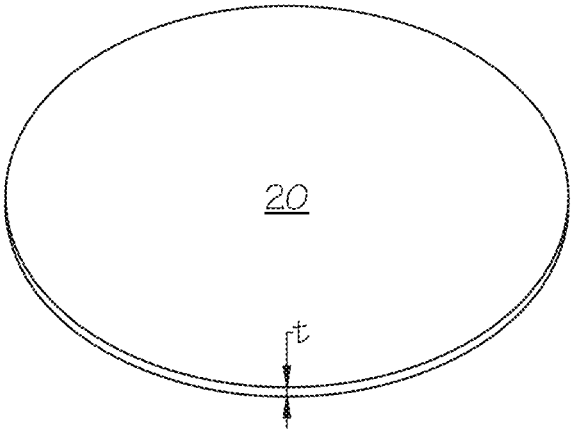
FIGS. 2A and 2B are perspective and sectional side views of exemplary coated paperboard bottom blank.
Figure 2B:
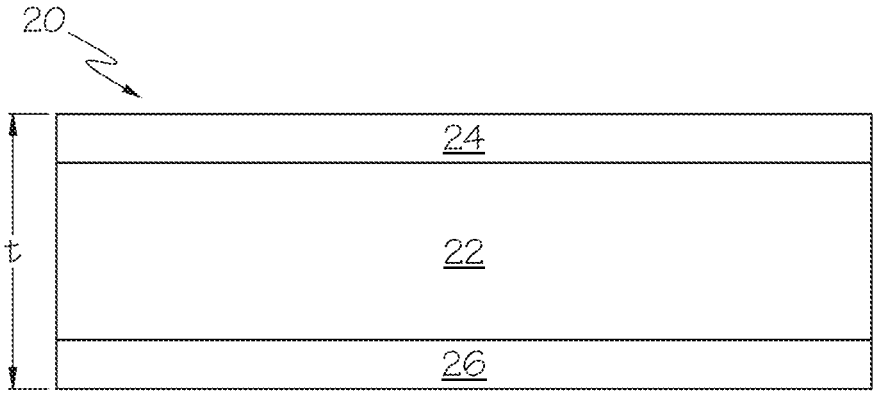

As shown in FIGS. 2A and 2B, the coated paperboard bottom blank 20 may include a layered structure that includes a paperboard substrate 22 having a first major side and a second major side, a first barrier coating layer 24 applied to the first major side of the paperboard substrate 22 and a second barrier coating layer 26 applied to the second major side of the paperboard substrate 22. However, the layered structure of the coated paperboard bottom blank 20 is not limited to the illustrated embodiment. In any case, the caliper thickness t of the coated paperboard bottom blank is considered to include the entire thickness of the coated paperboard bottom blank from a first outermost surface to an opposing second outermost surface.

Referring to the embodiment illustrated in FIGS. 2A and 2B, the first barrier coating layer 24 may define a first outermost surface of the coated paperboard bottom blank 20 and the second barrier coating layer 26 may define a second outermost surface of the coated paperboard bottom blank 20.

At this point, those skilled in the art will appreciate that various additional layers may be incorporated into the coated paperboard bottom blank 20 without departing from the scope of the present disclosure. In one variation, the coated paperboard bottom blank 20 may include a first basecoat between the paperboard substrate 22 and the first barrier coating layer 24, and the coated paperboard bottom blank 20 may include a second basecoat between the paperboard substrate 22 and the second barrier coating layer 26, or a third topcoat on top of the second barrier coating layer 26. In another variation, the coated paperboard bottom blank 20 may only include only a first barrier coating layer 24 on the paperboard substrate 22 without the second barrier coating layer 26.

The paperboard substrate 22 of the coated paperboard bottom blank 20 may be (or may include) any cellulosic material that is capable of being coated with the barrier coating layers. Those skilled in the art will appreciate that the paperboard substrate 22 may be bleached or unbleached. Examples of appropriate paperboard substrates include corrugating medium, linerboard, solid bleached sulfate (SBS), folding box board (FBB), and coated unbleached kraft (CUK).

The paperboard substrate 22 may have an uncoated basis weight of at least about 40 pounds per 3000 ft2. In one expression the paperboard substrate 22 may have an uncoated basis weight ranging from about 40 pounds per 3000 ft2 to about 300 pounds per 3000 ft2. In another expression the paperboard substrate 22 may have an uncoated basis weight ranging from about 85 pounds per 3000 ft2 to about 300 pounds per 3000 ft2. In another expression the paperboard substrate 22 may have an uncoated basis weight ranging from about 85 pounds per 3000 ft2 to about 250 pounds per 3000 ft2. In yet another expression the paperboard substrate 22 may have an uncoated basis weight ranging from about 100 pounds per 3000 ft2 to about 250 pounds per 3000 ft2.

Furthermore, the paperboard substrate 22 may have a caliper (thickness) ranging, for example, from about 4 points to about 30 points (0.004 inch to 0.030 inch). In one expression, the caliper range is from about 8 points to about 24 points. In another expression, the caliper range is from about 10 points to about 20 points.

One specific, non-limiting example of a suitable paperboard substrate 22 is a 13-point SBS cupstock manufactured by WestRock Company of Atlanta, Ga. Another specific, non-limiting example of a suitable paperboard substrate 22 is a 12.4-point SBS cupstock manufactured by WestRock Company. Yet another specific example of a suitable paperboard substrate 22 is an 18-point SBS cupstock manufactured by WestRock Company.

The first barrier coating layer 24 and second barrier coating layer 26 may be applied using any suitable method, such as one or more coaters either on a paper machine or as off-machine coater(s) such that the first barrier coating layer 24 and second barrier coating layer 26 are formed on the exposed, outermost surfaces of the paperboard substrate 22. In an aspect, the first barrier coating layer 24 and the second barrier coating layer 26 may be heat-sealable barrier coating layers. When heated, a heat-seal coating provides an adhesion to other regions of a product (e.g. sidewall of a container) with which it contacts.

The first barrier coating layer 24 and second barrier coating layer 26 may be applied to the paperboard substrate 22 at various coat weights. As one, non-limiting example, the first barrier coating layer 24 and second barrier coating layer 26 may be applied at a coat weight of about 2 to 20 pounds per 3,000 square feet. As another, non-limiting example, the first barrier coating layer 24 and second barrier coating layer 26 may be applied at a coat weight of about 4 to 14 pounds per 3,000 square feet.

The first barrier coating layer 24 and second barrier coating layer 26 may include a binder and a pigment. In one expression, the ratio of the binder to the pigment can be at least about 1:2 by weight. In another expression, the ratio of the binder to the pigment can be about 1:2 to about 9:1 by weight. In another expression, the ratio of the binder to the pigment can be about 1:1 to about 4:1 by weight. In yet another expression, the ratio of the binder to the pigment can be at least about 1:1 by weight.

The binder may be an aqueous binder. As one general, non-limiting example, the binder may be styrene-acrylate (SA) (i.e., the binder "consists of" or "consists essentially of" styrene-acrylate (SA)). As another general, non-limiting example, the binder may be a mixture of binders that includes styrene-acrylate (SA). Other aqueous binders are also contemplated, such as styrene-butadiene rubber (SBR), ethylene acrylic acid (EAA), polyvinyl acrylic, polyvinyl acetate (PVAC), polyester dispersion, and combinations thereof.

In one variation, the pigment may be a clay pigment. As one example, the clay pigment may be kaolin clay, such as a fine kaolin clay. As another example, the clay pigment may be platy clay, such as a high aspect ratio platy clay (e.g., aspect ratio of at least 40:1). In another variation, the pigment may be a calcium carbonate ($CaCO3$) pigment. In yet another variation, the pigment may be a pigment blend that includes both calcium carbonate pigment and clay pigment.

Returning to FIG. 1, the method includes, at block 14, heating the coated paperboard bottom blank. It has been discovered that cracking of a coating during a shaping process of a coated paperboard bottom blank can be reduced by heating the coated paperboard bottom blank before the shaping process. Although the invention is not limited by theory, it is believed that heating the coated paperboard bottom blank may increase a pliability of a barrier coating layer on a paperboard substrate and/or may increase a pliability of the paperboard substrate to relieve a stress transfer between the barrier coating layer and the paperboard substrate during a forming process. For conventional polyethylene extrusion coated paperboard, heating of the polyethylene coating is typically unnecessary due to excellent flexibility of the polyethylene extrusion coating. Although it has been shown that cracking during a shaping process of an aqueous coated paperboard bottom blank has been reduced by pre-heating, it is projected that pre-heating can be effective for other coatings.

In an aspect, the heating of the coated paperboard bottom blank includes heating at least a portion of the coated paperboard bottom blank to above 90° F., preferably above 100° F., and more preferably above 110° F. It is expected that the effect of the heating on reduced cracking is enhanced as a function of increasing temperature.

The heating of the coated paperboard bottom blank is not limited by any particular process.

In one variation, the heating of the coated paperboard bottom blank may include heating the coated paperboard bottom blank using a non-contact heating, such as a hot air blower or infrared heater.

In another variation, the heating of the coated paperboard bottom blank may include contacting the coated paperboard bottom blank with a heated die during a process for shaping the heated coated paperboard bottom blank.

Experimental tests have tested hot air up to 1100° F. and tool heat up to 230° F. (combined as well as separately). It was found that more heat tends to reduce cracking. It is expected that higher temperatures than those tested may further reduce cracking.

In an aspect, the method may omit the step of heating the coated paperboard bottom blank.

Figure 3A:
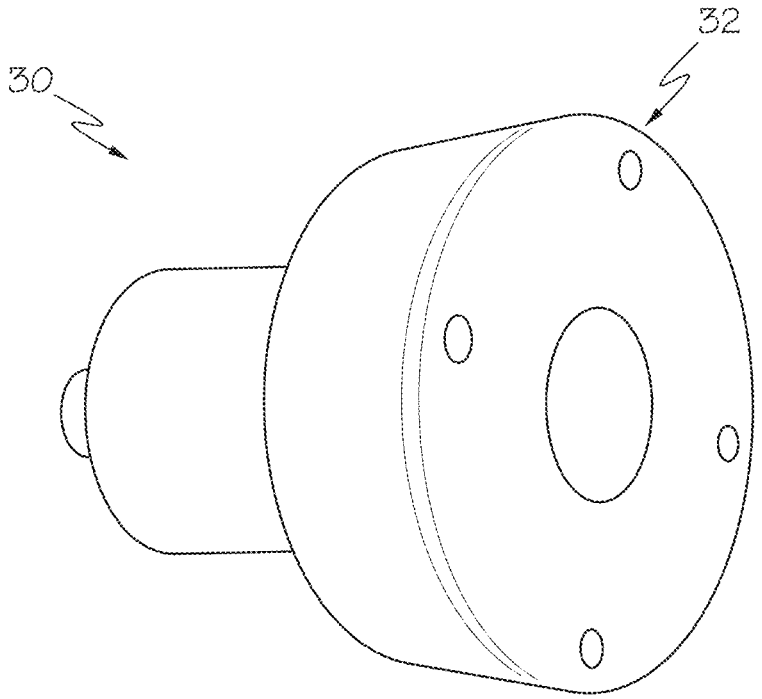
FIGS. 3A and 3B are perspective and sectional side view of an exemplary punch having a leading-edge radius that may be used in a step of shaping a coated paperboard bottom blank.
Figure 3B:
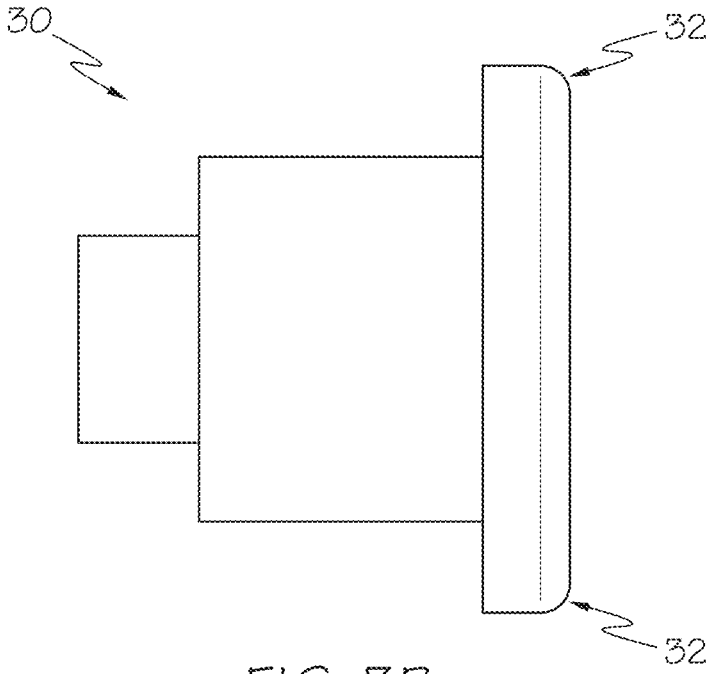

Returning to FIG. 1, the method includes, at block 16, shaping the coated paperboard bottom blank using a punch, thereby forming a peripheral skirt portion about a periphery of a bottom wall portion of the coated paperboard bottom blank, the punch having a leading-edge radius of greater than 3t. FIGS. 3A and 3B illustrate an exemplary punch 30 having a leading-edge radius 32 that may be used in a step of shaping the coated paperboard bottom blank.

Figure 4A:
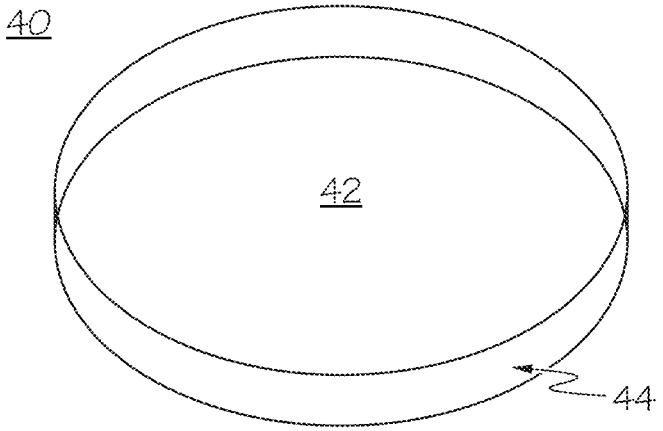
FIG. 4A is a lower perspective view of an exemplary bottom blank after a shaping step having a peripheral skirt portion about a periphery of a bottom wall portion.
Figure 4B:
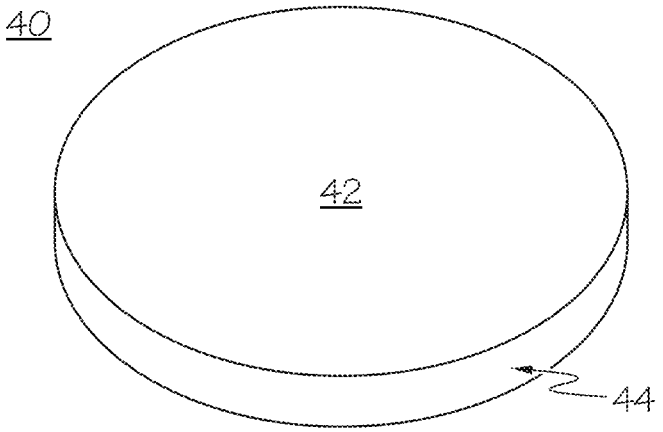
FIG. 4B is an upper perspective view of an exemplary bottom blank after a shaping step having a peripheral skirt portion about a periphery of a bottom wall portion.

FIGS. 4A and 4B illustrate an exemplary bottom blank 40 after the shaping step having a peripheral skirt portion 44 about a periphery of a bottom wall portion 42.

It has been discovered that cracking of a coating during a shaping process of a coated paperboard bottom blank can be reduced by increasing a leading-edge radius of a punch used during the shaping process. Although the invention is not limited by theory, it is believed that increasing a leading-edge radius of a punch used during the shaping process may distribute a deformation of a barrier coating layer on a paperboard substrate over a larger area of the barrier coating layer, thus reducing the maximum strains required for the barrier coating layer to survive the forming process without cracking. For conventional polyethylene extrusion coated paperboard, a punch with a smaller leading-edge radius of the punch used during the shaping process is typically utilized.

In an aspect, the punch preferably has a leading-edge radius of greater than 4t, more preferably greater than 5t, even more preferably greater than 6t, even more preferably greater than 7t.

A preferred method includes pre-heating the coated paperboard bottom blank and shaping the heated paperboard bottom blank using a punch having a leading-edge radius of greater than 3t. It has been discovered that the combined effect of pre-heating and increased a leading-edge radius considerably minimizes cracking of a coating during the shaping process. However, in a variation, the pre-heating may be employed with a conventional leading-edge radius of a punch during a shaping process or the pre-heating may be employed with any other shaping process. In another variation, the punch having a leading-edge radius of greater than 3t may be employed without pre-heating.

In an aspect, the method may be performed by a cup bottom forming apparatus having a built-in heater. The cup bottom forming apparatus includes a punching assembly for shaping the coated paperboard bottom blank to form a peripheral skirt portion about a periphery of a bottom wall portion of the coated paperboard bottom blank and a heater positioned to heat the coated paperboard bottom blank prior to and/or during formation of the peripheral skirt portion.

In an aspect, the heater includes a non-contact heater positioned to heat the coated paperboard prior to the punching of the coated paperboard bottom blank.

In another aspect, the heater includes a contact heater positioned to heat a die contacting the coated paperboard within the punching assembly.

The cup bottom forming apparatus may further include a cutting assembly for cutting the coated paperboard bottom blank from a web of coated paperboard.

In an aspect, the heater includes a non-contact heater positioned to heat the coated paperboard prior to the cutting of the coated paperboard bottom blank.

In an aspect, the heater includes a contact heater positioned to heat a die contacting the coated paperboard within the cutting assembly.

Figure 5A:
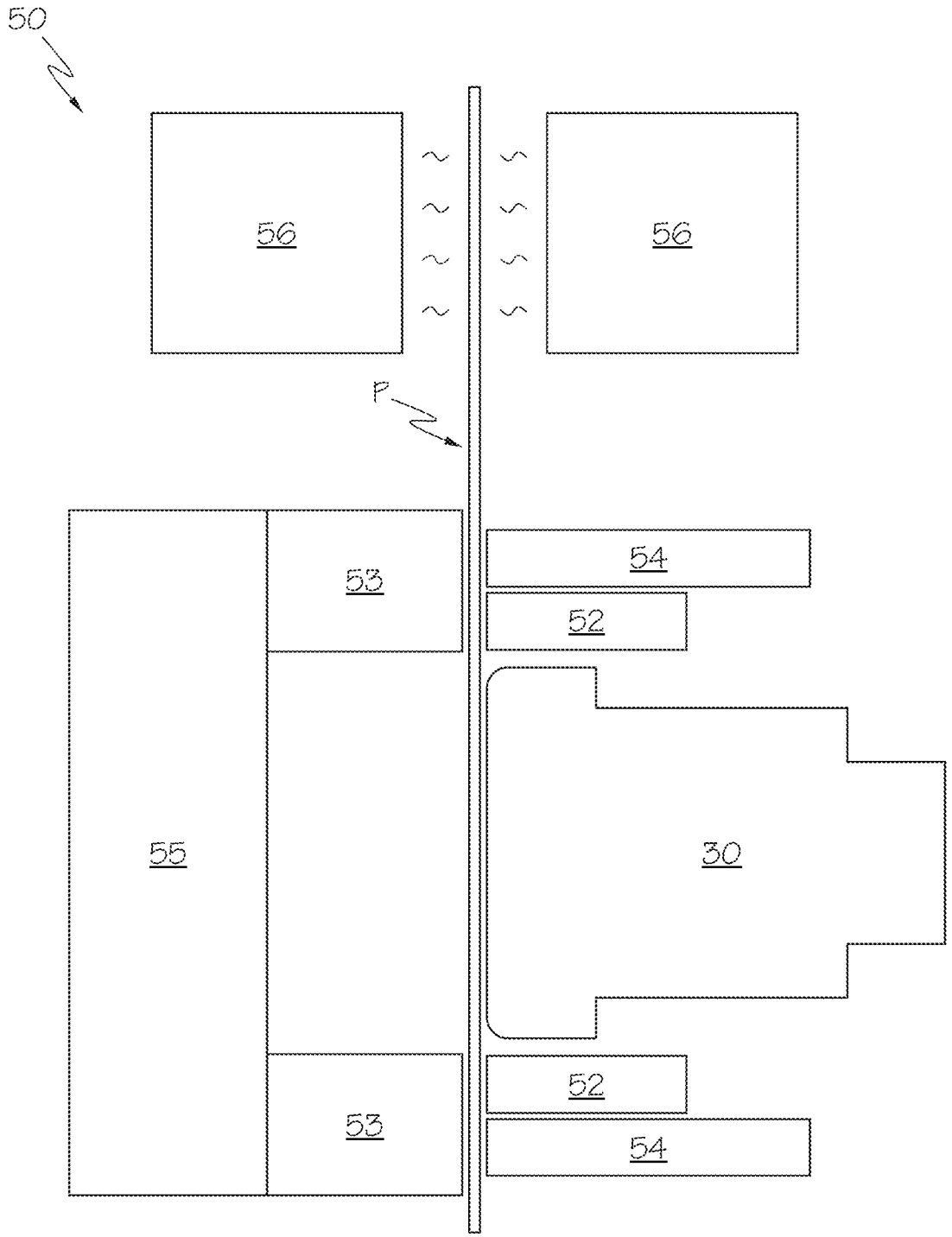
FIGS. 5A, 5B and 5C are schematic views of an exemplary cup bottom forming apparatus for shaping a coated paperboard bottom blank.
Figure 5B:
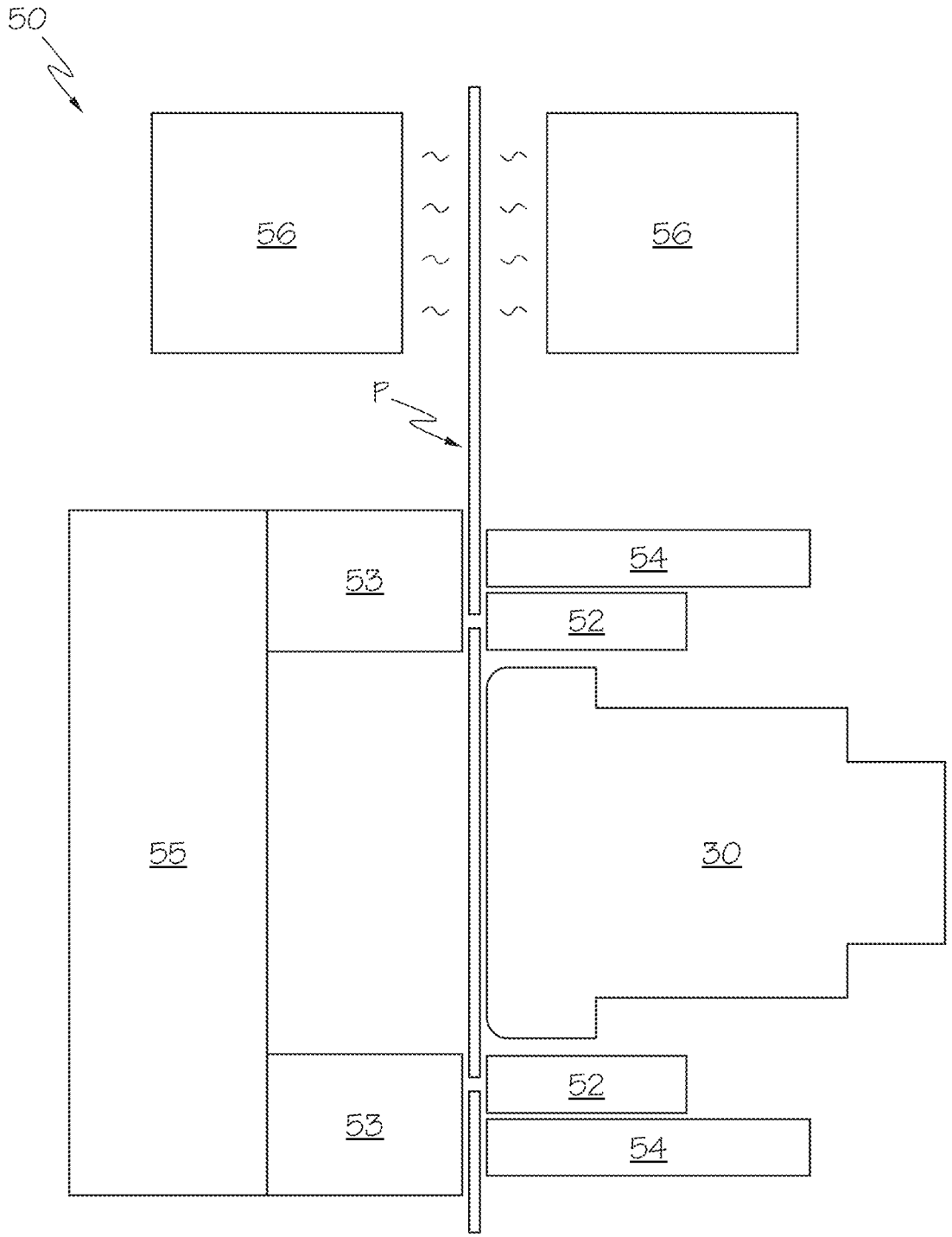
Figure 5C:
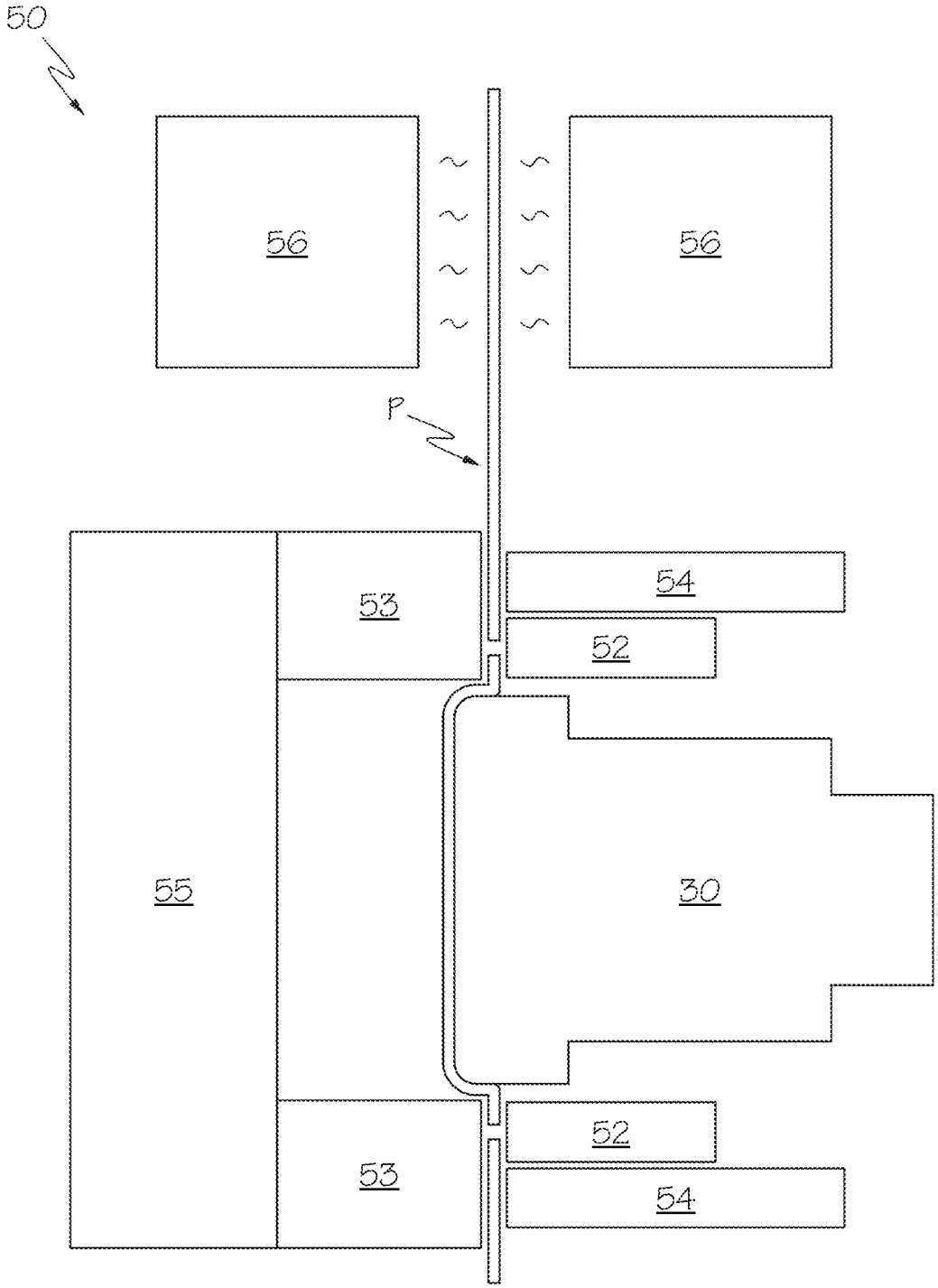

FIGS. 5A, 5B and 5C are schematic views of an exemplary cup bottom forming apparatus 50 for shaping a coated paperboard bottom blank cut from a roll of paper that feeds a strip of paper vertically downward in the illustrated figures. As shown, the cup bottom forming apparatus includes a punch 30 around which the peripheral skirt is formed as the punch draws the cut-out blank through the main die 53. In an aspect, the cup bottom forming apparatus 50 may further includes cutters 52 for cutting the coated paperboard into a coated paperboard bottom blank, and casing 54. The punch 30 and cutters 52 may be attached to a piston (not shown) to perform their respective functions.

In an aspect, the cup bottom forming apparatus 50 may further include a contact heater 55 for heating a die during a process for shaping the heated coated paperboard bottom blank P. It should be understood that the placement of the contact heater is merely illustrative and that any of the dies or tools in the cup bottom forming apparatus 50, including punch 30, contacting the coated paperboard bottom blank P may be heated to affect the heating of the coated paperboard bottom blank P.

In an aspect, the cup bottom forming apparatus 50 may further include non-contact heaters 56 for heating the coated paperboard P. In an example, the non-contact heaters 56 may include a hot air blower blowing heated air to the frontside and/or backside of the coated paperboard P. In another example, the non-contact heaters 56 may include an infrared heater for heating the frontside and/or backside of the coated paperboard P.

In an aspect, the cup bottom forming apparatus 50 may further include contact heaters 56 for heating a die in contact with the coated paperboard P. In an example, the contact heaters 56 may include heating tape held onto the respective dies with heat-reflective metallic tape.

However, it should be understood that the cup bottom forming apparatus of FIGS. 5A, 5B and 5C is merely a representation of one exemplary cup bottom forming apparatus for practicing the invention.

Figure 6:
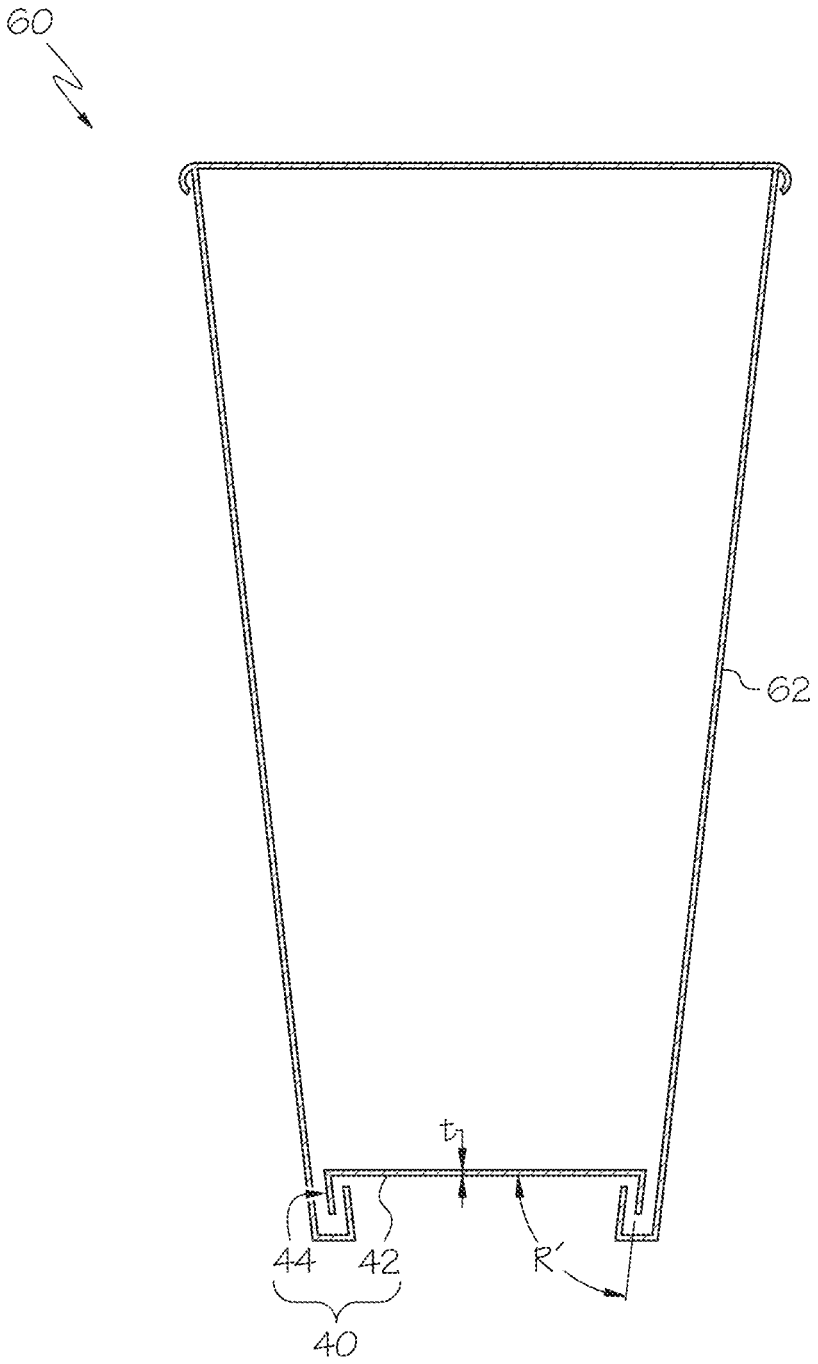
FIG. 6 is a sectional schematic view of a representation of a coated paperboard container according to an embodiment of the present invention.

FIG. 6 is a sectional schematic view of a representation of a coated paperboard container according to an embodiment of the present invention.

As shown in FIG. 6, the coated paperboard container 60 includes a coated paperboard bottom 40 having a caliper thickness t and a coated paperboard sidewall 62. The coated paperboard bottom 40 includes a paperboard substrate and a first barrier coating layer on an outermost surface of the paperboard substrate (see FIGS. 2A and 2B) and the coated paperboard bottom 40 includes peripheral skirt portion 44 formed about a periphery of a bottom wall portion 42, wherein a radius R' defining between the peripheral skirt portion 44 and the bottom wall portion 42 is greater than 3t. The coated paperboard sidewall 62 is sealed to the first barrier coating layer of the peripheral skirt portion 44.

In an aspect, the radius R' corresponds to a radius R of a punch used to shape the peripheral skirt portion 44 and the bottom wall portion 42 from a coated paperboard bottom blank.

In an aspect, the paperboard bottom further includes a second barrier coating layer on another outermost surface of the paperboard substrate, and the coated paperboard sidewall may be sealed to the second barrier coating layer of the peripheral skirt portion. For example, as illustrated, a bottom portion of the paperboard sidewall may be folded over the peripheral skirt and bonded (e.g. heat-sealed) to both sides of the peripheral skirt.

In an aspect, the interior surface of the coated paperboard sidewall may include a barrier coating at an outermost surface thereof. For example, the barrier coating may the same as one or both of the barrier coatings on the paperboard bottom. In an aspect, the barrier coating may comprise an aqueous binder, such as styrene-acrylate.

In an aspect, the radius defining between the peripheral skirt portion and the bottom wall portion is preferably greater than 4t, more preferably greater than 5t, even more preferably greater than 6t, and even more preferably greater than 7t.

EXAMPLES

Examples 1-4

The bottom stock used in the cup examples was made on a pilot blade coater using 13 pt solid bleached sulfate (SBS) cupstock as substrate, which was manufactured by WestRock Company of Atlanta, Ga. The felt side of the paperboard was coated with a heat-sealable barrier coating at a coat weight of 10 lb/3000 $ft^2$, and the formulation contained HYDROCARB® 60 (Omya AG of Oftringen, Germany), BARRISURF™ HX (IMERYS Kaolin), ROPAQUE™ AF-1353 (The Dow Chemical Company), and CARTASEAL® SCR (Archroma) at a ratio of 31.4/62.8/5.8/200 by weight. The coated felt side was facing inside of the cup, which had a 30-min water Cobb of 14.1 $g/m^2$. The wire side of the paperboard was coated with two layers of a barrier coating at a coat weight of 8.7 and 2.1 lb/3000 $ft^2$, respectively, and the barrier coating formulation contained HYDROCARB® 60, BARRISURF™ HX, ROPAQUE™ AF-1353, and CARTASEAL® SCR at a ratio of 31.4/62.8/5.8/100 by weight. The coated wire side was facing external side of the cup, which had a 30-min water Cobb of 18.0 $g/m^2$.

The side wall blanks used in the examples were die cut from paperboard, which was coated on a pilot coater with a base coat and a heat-sealable barrier top coat on the wire side of 18 pt SBS cupstock manufactured by WestRock Company. The base coat formulation contained 100 parts of CaCO3 (HYDROCARB® 60, or HYDROCARB® HG, both from Omya AG of Oftringen) or clay (HYDRAFINE® 90W, from KaMin LLC of Macon, Ga.) as pigment and 35 parts of SA binder (ACRONAL® S 504, from BASF Corporation) for a coat weight of about 9-10 lb/3000 $ft^2$, and the base coat was applied by a blade coater. The heat-sealable barrier top coat formulation contained 100 percent of SA binder (CARTASEAL® SCR, from Archroma), and the top coat was applied on a rod coater using an IPI #030 rod for an estimated coat weight of about 4 lb/3000 $ft^2$. The coated surface exhibited a 30-min water Cobb of 5.2-7.2 $g/m^2$.

Examples 5-9

The bottom stock used in the cup examples was made on a pilot blade coater using 13 pt SBS cupstock as substrate and a heat-sealable barrier coating formulation at a coat weight of 9 lb/3000 $ft^2$ on the felt side and 11 lb/3000 $ft^2$ on the wire side. The barrier coating formulation contained HYDROCARB® 60 (Omya AG of Oftringen), BARRISURF™ HX (IMERYS Kaolin), ROPAQUE™ AF-1353 (The Dow Chemical Company), and CARTASEAL® SCR (Archroma) at a ratio of 62.8/31.4/5.8/300 by weight. The coated felt side was facing inside of the cup, which had a 30-min water Cobb of 4.2 $g/m^2$. The coated wire side was facing external side of the cup, which had a 30-min water Cobb of 16.6 $g/m^2$.

The side wall blanks used in the examples were die cut from paperboard that was coated on a pilot blade coater using 18 pt SBS cupstock as substrate and the same heat-sealable barrier coating formulation as that used for the bottom stock at a coat weight of 10.6 lb/3000 $ft^2$. The coated surface of the heat-sealable sidewall had a 30-min water Cobb of 5.7 $g/m^2$.

Results

Figure 7:
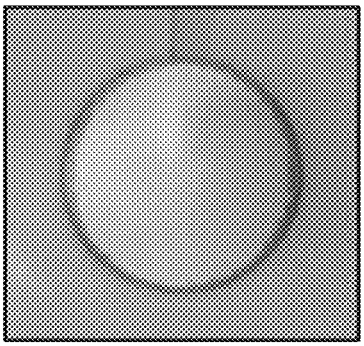
FIG. 7 is a table depicting staining of cups due to coffee with non-dairy creamer for punch and heating combinations, per Examples 1-4.
Figure 7:
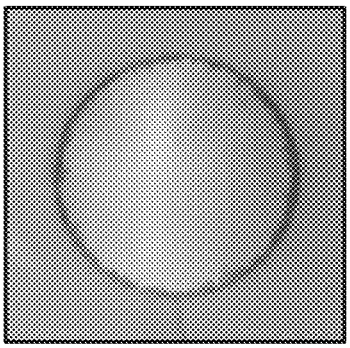
Figure 7:
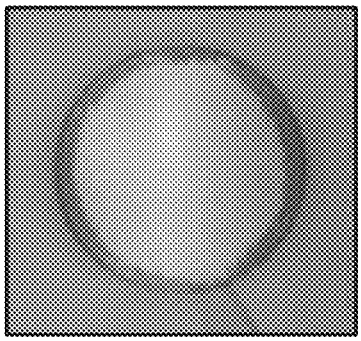
Figure 7:
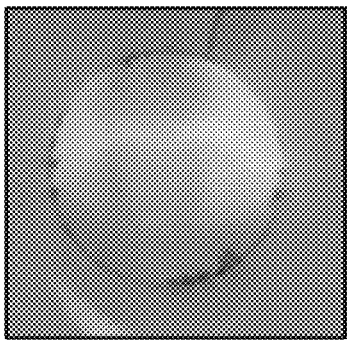
Figure 8:
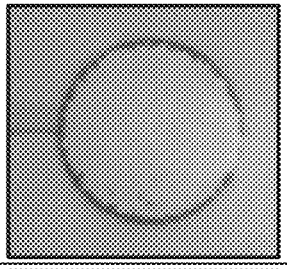
FIG. 8 is a table depicting staining of cups due to coffee with non-dairy creamer for various punch conditions and a constant heating condition, per Examples 5-9.
Figure 8:
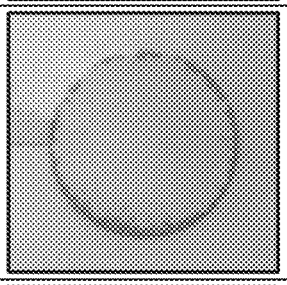
Figure 8:
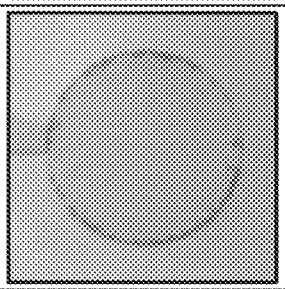
Figure 8:
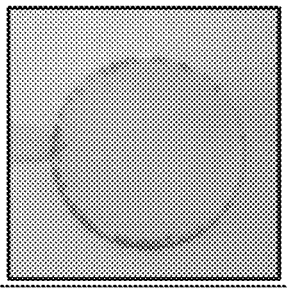
Figure 8:
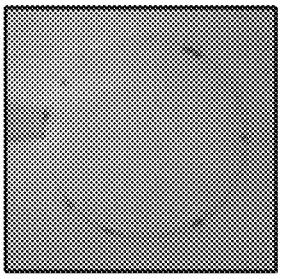

FIGS. 7 and 8 show the penetration of a hot coffee and non-dairy creamer mixture into the cup bottom after 30 minutes (viewed from above after the coffee has been drained and rinsed out) for the current and proposed solutions for cup forming of a barrier coating. Note that the proposed solutions were produced with preliminary heat application and a selection of proposed punch radii, and better results may be achievable with further refinement and optimization of the process parameters. Conditions with a punch leading-edge radius of 3/32" (R=6.7t) and greater show distances between coffee stains sometimes greater than 0.5".

The coffee staining shown in FIGS. 7 and 8 relate to a worst-case condition (very hot coffee with a particularly aggressive non-dairy creamer). These cups, with the exception of conventionally produced cups, typically do not show staining for other less aggressive liquids such as standard coffee, Coca-Cola®, etc.

Although various embodiments of the disclosed methods and coated paperboard containers have been shown and described, modifications may occur to those skilled in the art upon reading the specification. The present application includes such modifications and is limited only by the scope of the claims.

What is claimed is:

1. A method of manufacturing a coated paperboard container, the method comprising:

providing a coated paperboard bottom blank, the coated paperboard bottom blank comprising a paperboard substrate and a first barrier coating layer on a first outermost surface of the paperboard substrate, wherein the first barrier coating layer is an aqueous barrier coating layer;

heating the coated paperboard bottom blank, wherein heating the coated paperboard bottom blank comprises heating at least a portion of the coated paperboard bottom blank to above 90° F.;

shaping the heated coated paperboard bottom blank while the portion of the coated paperboard bottom blank is above 90° F., thereby forming a peripheral skirt portion about a periphery of a bottom wall portion of the coated paperboard bottom blank; and sealing a coated paperboard sidewall to the first barrier coating layer of the peripheral skirt portion.

2. The method of claim 1 wherein the paperboard bottom blank further comprises a second barrier coating layer on a second surface of the paperboard substrate.

3. The method of claim 2 further comprising scaling the coated paperboard sidewall to the second barrier coating layer of the peripheral skirt portion.

4. The method of claim 1 wherein the first barrier coating layer comprises at least one of styrene-acrylate, styrene-butadiene rubber, ethylene acrylic acid, polyvinyl acetate, polyvinyl acrylic, and polyester dispersion.

5. The method of claim 1 wherein heating the coated paperboard bottom blank comprises heating the coated paperboard bottom blank using a non-contact heater.

6. The method of claim 1 wherein heating the coated paperboard bottom blank comprises contacting the coated paperboard bottom blank with a heated die before and/or during a process for shaping the heated coated paperboard bottom blank.

7. A method of manufacturing a coated paperboard container, the method comprising:

providing a coated paperboard bottom blank having a caliper thickness t, the coated paperboard bottom blank comprising a paperboard substrate and a first barrier coating layer on a first outermost surface of the paperboard substrate, wherein the first barrier coating layer is an aqueous barrier coating layer;

shaping the coated paperboard bottom blank using a punch, thereby forming a peripheral skirt portion about a periphery of a bottom wall portion of the coated paperboard bottom blank, the punch having a leading-edge radius of greater than 3t; and sealing a coated paperboard sidewall to the first barrier coating layer of the peripheral skirt portion.

8. The method of claim 7 wherein the paperboard bottom blank further comprises a second barrier coating layer on a second surface of the paperboard substrate.

9. The method of claim 8 further comprising sealing the coated paperboard sidewall to the second barrier coating layer of the peripheral skirt portion.

10. The method of claim 7 wherein the first barrier coating layer comprises at least one of styrene-acrylate, styrene-butadiene rubber, ethylene acrylic acid, polyvinyl acetate, polyvinyl acrylic, and polyester dispersion.

11. The method of claim 7 wherein the punch has a leading-edge radius of greater than 4t.

12. The method of claim 7 wherein the punch has a leading-edge radius of greater than 6t.

13. The method of claim 7 further comprising heating the coated paperboard bottom blank before and/or during the step of shaping the coated paperboard bottom blank such that the heated coated paperboard bottom blank is shaped using the punch.

* * * * *